US005505319A

United States Patent [19]

Todd, Jr.

[11] Patent Number: 5,505,319

[45] Date of Patent: Apr. 9, 1996

[54] DISPLAY RACK

[76] Inventor: Alvin E. Todd, Jr., 3360 Progress Hill Blvd., Pigeon Forge, Tenn. 37863

[21] Appl. No.: 169,502

[22] Filed: Dec. 17, 1993

Related U.S. Application Data

[63] Continuation-in-part of Ser. No. 116,690, Sep. 3, 1993, which is a continuation-in-part of Ser. No. 922,150, Jul. 30, 1992, Pat. No. 5,242,054, which is a continuation-in-part of Ser. No. 734,458, Jul. 23, 1991, abandoned, which is a continuation-in-part of Ser. No. 549,606, Jul. 5, 1990, Pat. No. 5,090,570.

[51] Int. Cl.[6] ..... A47F 5/00

[52] U.S. Cl. ..... 211/95; 211/96; 211/163

[58] Field of Search ..... 211/95, 163, 96, 211/165, 168, 187, 186

[56] References Cited

U.S. PATENT DOCUMENTS

| | | | |
|---|---|---|---|
| 1,875,563 | 9/1932 | Cooke et al. . | |
| 2,868,386 | 1/1959 | Seyforth | 211/95 |
| 3,127,993 | 4/1964 | Phipps . | |
| 3,129,817 | 4/1964 | Rohdin . | |
| 3,184,059 | 5/1965 | Kaplan . | |
| 3,298,515 | 1/1967 | Watts, Jr. . | |
| 3,693,807 | 9/1972 | Larson . | |
| 3,761,289 | 9/1973 | Wolf . | |
| 3,861,528 | 1/1975 | Damuth . | |
| 3,861,578 | 1/1975 | McHan . | |
| 3,986,611 | 10/1976 | Dreher . | |
| 4,020,694 | 5/1977 | Mayhew . | |
| 4,170,294 | 10/1979 | Zelinski . | |
| 4,269,124 | 5/1981 | Rosenthal et al. | 211/163 X |
| 4,319,684 | 5/1982 | Backman et al. . | |
| 4,456,124 | 6/1984 | Kay et al. . | |
| 4,499,353 | 2/1985 | Shields . | |
| 4,567,981 | 2/1986 | Headon . | |
| 4,669,610 | 6/1987 | Lindsey et al. . | |
| 4,739,883 | 4/1988 | Mohs et al. . | |
| 4,779,734 | 10/1988 | Kydonieus . | |
| 4,804,984 | 2/1989 | Heuer et al. . | |
| 4,875,593 | 10/1989 | Trimble | 211/115 X |
| 4,877,137 | 10/1991 | Govang et al. . | |
| 5,228,582 | 7/1993 | Marshall et al. | 211/95 X |
| 5,242,054 | 9/1993 | Todd . | |

FOREIGN PATENT DOCUMENTS

| | | | |
|---|---|---|---|
| 1269311 | 5/1968 | Germany | 211/95 |
| 270127 | 4/1969 | Germany . | |

*Primary Examiner*—Robert W. Gibson, Jr.
*Attorney, Agent, or Firm*—Pitts & Brittian

[57] ABSTRACT

An improved display rack (10) which is supported by existing facilities such as existing shelving (44), an existing suspended ceiling (50) or the floor (48). The improved display rack (20) provides a rotatable display unit (20) and a securing assembly (36) for securing the improved display rack (10) to the existing facilities. The improved display rack (10) may be used to display such things as ceiling fan pulls, postcards, greeting cards, key chains, and comic books. The improved display rack (10) can provide a hinge (70) such that the rotatable display unit (20) can be pivoted away from the existing facility.

12 Claims, 7 Drawing Sheets

DISPLAY RACK

This application in part discloses and claims subject matter disclosed in my earlier filed application, Ser. No. 08/116,690, filed Sep. 3, 1993; which is a continuation-in-part of my earlier filed application, Ser. No. 07/922,150, filed Jul. 30, 1992, which issued as U.S. Pat. No. 5,242,054 on Sep. 7, 1993; which is a continuation-in-part of my earlier filed application, Ser. No. 07/734,458, filed Jul. 23, 1991, now abandoned; which is a continuation-in-part of my earlier filed application, Ser. No. 07/549,606, filed Jul. 5, 1990, which issued as U.S. Pat. No. 5,090,570 on Feb. 25, 1992.

TECHNICAL FIELD

This invention relates to the field of display racks. More specifically, it relates to a device which will allow a rotatable display unit, such as those on which ceiling fan pulls, postcards, greeting cards, key chains, and comic books are displayed, to be used in conjunction with existing facilities such as a shelving unit, a suspended ceiling or a floor.

BACKGROUND ART

The objective of mass merchandisers is to display as much product as possible in a given amount of floor space. This allows the merchandiser to carry a wide variety of merchandise. Mass merchandisers do this in the hope that the shopper will not have to go to any other store to fulfill any consumer needs.

It is well known that shelving is commonly used to display the merchandise. It is also well known that the shelving is typically positioned and dimensioned so as to maximize the amount of merchandise displayed in any given area of floor space while allowing shoppers to easily view the merchandise and still meet any local regulations such as fire codes.

Another common method of displaying merchandise is the use of the rotatable, stand-alone, floor display racks such as those on which ceiling fan pulls, postcards, greeting cards, key chains, and comic books are displayed. These racks typically stand alone and require extra floor space. Mass merchandisers may be prohibited from carrying merchandise which uses this type of display because of a lack of the required floor space. In addition, these racks usually have a base and/or legs which prohibit their use on existing shelving.

Another drawback is that these rotatable, stand-alone, floor display racks usually only stand 6 to 8 feet high which is lower than the height of most mass merchandisers' ceilings or existing shelving. Thus, these racks do not allow the greatest amount of merchandise possible to be displayed in the amount of floor space that such a rack takes up. As such, a mass merchandiser may refuse to carry a product if the manufacturer offers no alternate method of display to the rotatable, stand-alone, floor display rack.

Therefore, it is an object of this invention to provide an improved display rack capable of being supported by existing facilities such as a shelving unit, a suspended ceiling or a floor.

Further, it is an object of the present invention to provide such an improved display rack which is easily deployed and inexpensive.

DISCLOSURE OF THE INVENTION

Other objects and advantages will be accomplished by the present invention which provides a rotatable display unit to be used with existing facilities such as a shelving unit, a suspended ceiling or a floor. In accordance with the various features of the present invention, an improved display rack is provided. The improved display rack is generally comprised of a rotatable display unit and a securing assembly for securing at least a portion of the rotatable display unit to the existing facilities. Further, when the improved display rack is secured to an existing display shelving unit, hinge means may be implemented such that the rotatable display unit can pivot away from the existing shelving unit such that more shelving can be secured to the shelving unit.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
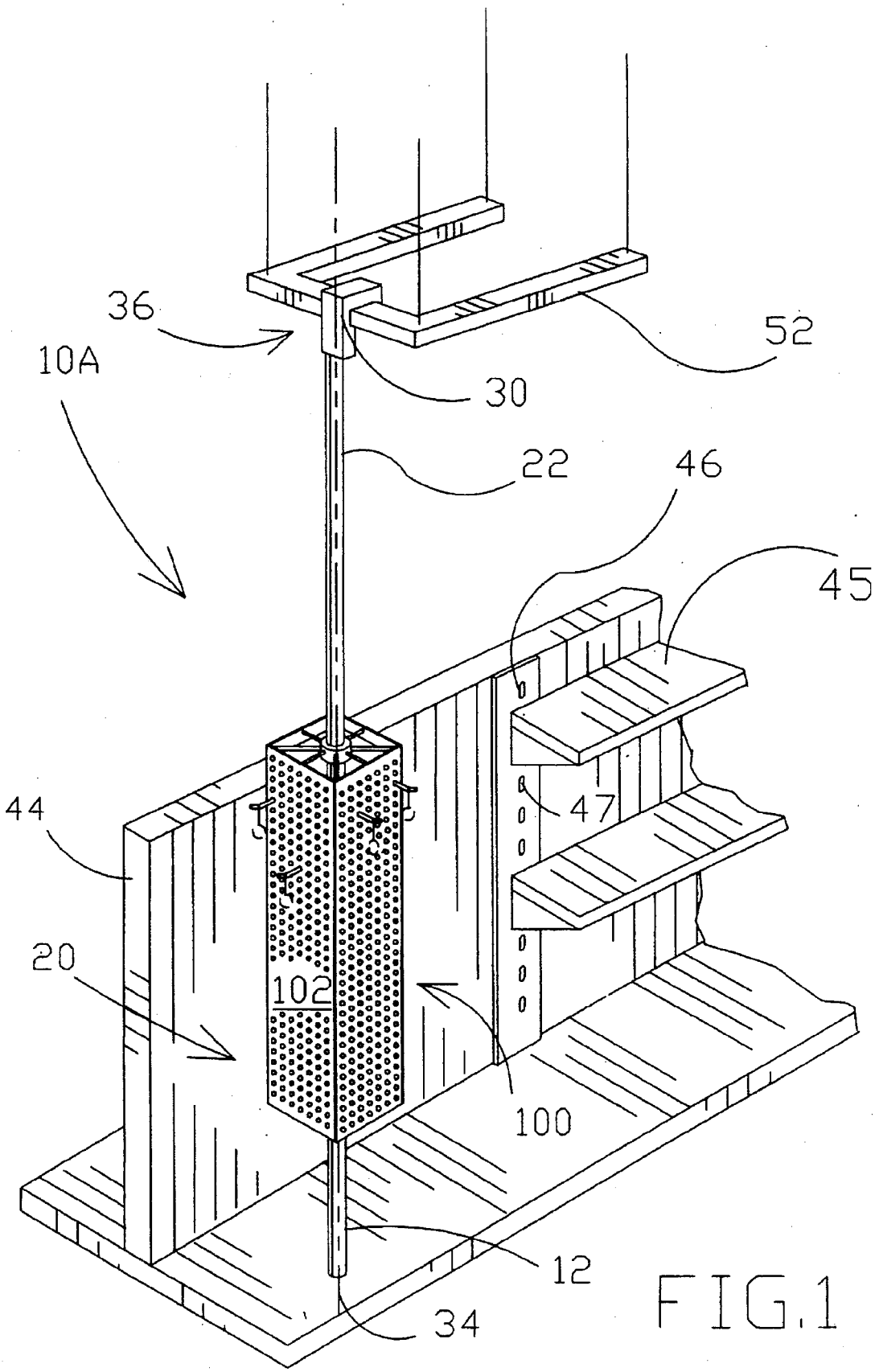
FIG. 1 is a perspective view of an alternate embodiment of the improved display rack of the present invention.

An improved display rack incorporating various features of the present invention is illustrated generally at 10 in the figures. The improved display rack 10 is designed to allow a rotatable display unit 20, which must normally stand alone in its own floor space, to be supported by existing facilities such as an existing shelving unit 44, an existing suspended ceiling 50 or a floor 48. In this way, the improved display rack 10 will not require the expanse of floor space typically dedicated to the display racks of the prior art. Moreover, the improved display rack 10 is inexpensive and easily deployed.

The improved display rack 10 is generally comprised of a rotatable display unit 20, an upper supporting member 22, a lower supporting member 12 and a securing assembly 36 for securing the improved display rack 10 to the existing display facilities such as a shelving unit 44 or a suspended ceiling 50. The lower supporting member 12 and upper supporting member 22 are substantially vertical. As shown in the Figures, the rotatable display unit 20 is supported between the lower supporting member 12 and the upper supporting member 22, in a manner such that the display unit 20 rotates with respect to a vertical axis 34. The rotatable display unit 20 is substantially similar to a conventional display unit, such as the stands typically used to display ceiling fan pulls, postcards, greeting cards, key chains, or comic books. As clearly shown in FIGS. 1 and 2, the rotatable display unit 20 defines an exterior surface 100 upon which merchandise is displayed. In the preferred embodiment, the exterior surface 100 is comprised of a plurality of panels 102 which are configured such that the panels 102 form a rectangular prism shape. Of course, it will be noted by those skilled in the art that the exterior surface 100 may define any selected configuration, such as cylindrical or multi-faceted.

FIG. 1 illustrates an embodiment of the improved display rack 10A which is configured such that the display rack 10A is supported by a suspended ceiling 50. The lower supporting member 12 defines a first end 13 and a second end 14. The first end 13 of the lower supporting member 12 is secured proximate the bottom of the rotatable display unit 20 such that the lower supporting member 12 extends in a downward direction coaxially with the vertical axis 34. The second end 14 of the lower supporting member 12 engages a selected horizontal support surface such as a floor, as shown in FIG. 1*a*, or the base of existing shelving 44, as shown in FIG. 1.

Figure 1A:
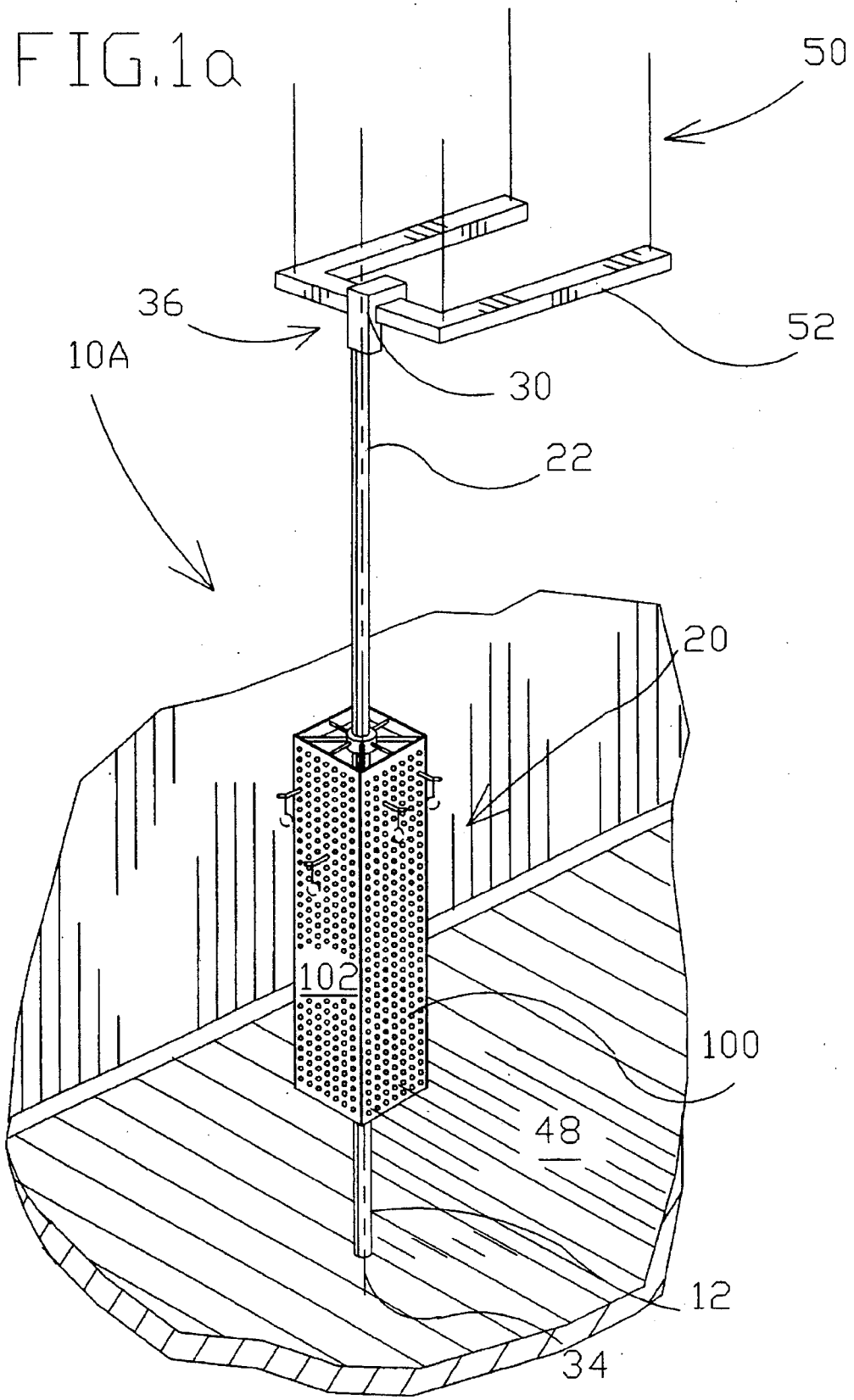
FIG. 1*a* is a perspective view of the improved display rack of FIG. 1 wherein the lower support member rests on a floor.

The upper supporting member 22, shown in FIGS. 1 and 1*a*, is substantially vertical and defines a first end 23 and a second end 24. The first end 23 of the upper supporting member 22 is secured proximate the top of the rotatable display unit 20 and extends in an upward direction coaxially with the vertical axis 34. The second end 24 carries the securing assembly 36. In the preferred embodiment, the securing assembly 36 is a clamp device 30 which securely engages a beam 52 of the existing suspended ceiling 50 in a manner such that the improved display rack 10A is securely supported by the suspended ceiling 50. The clamp device 30 may be formed integrally with the second end 24 or it may be selectively secured proximate to the second end 24 of the upper supporting member 22 in a conventional manner.

FIGS. 2, 3, 4, 5, 6 and 7 illustrate an alternate embodiment of the improved display rack 10B which is configured such that the display rack 10B is secured to and/or supported by an existing shelving unit 44. The upper supporting member 22 and the lower supporting member 12 are configured such that the display unit 20 is suspended between the first end 23 of the upper supporting member 22 and the first end 13 of lower supporting member 12. In the Figures, the securing assembly 36 is generally comprised of a horizontal support 16, 26 for each supporting member 12, 22, one end of which is secured to the supporting member 12, 22 and the other end of which carries an attachment member 32 such that the display rack 10B can be secured to the existing shelving unit 44.

Figure 2:
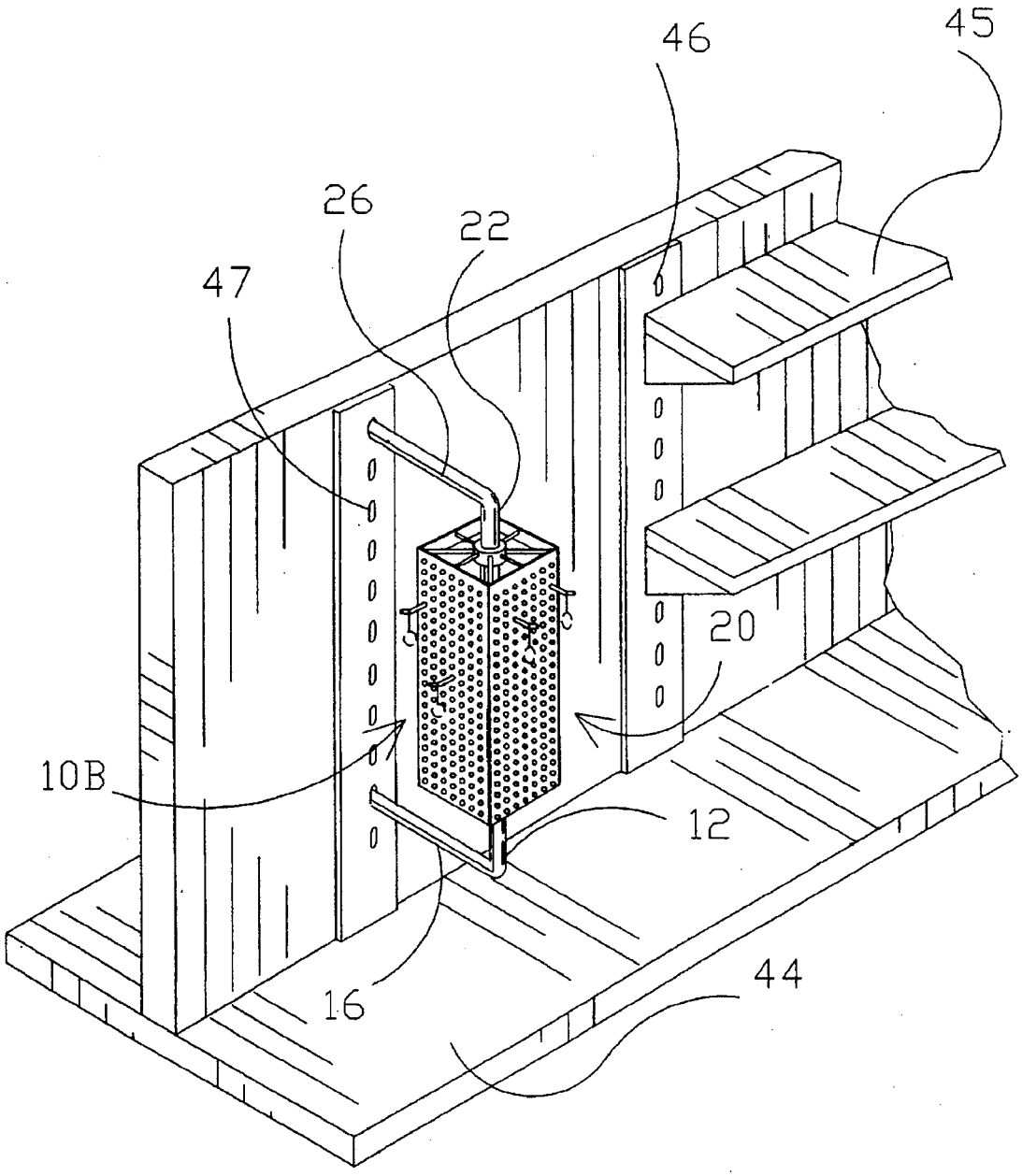
FIG. 2 is a perspective view of an alternate embodiment of an improved display rack of the present invention.
Figure 3:
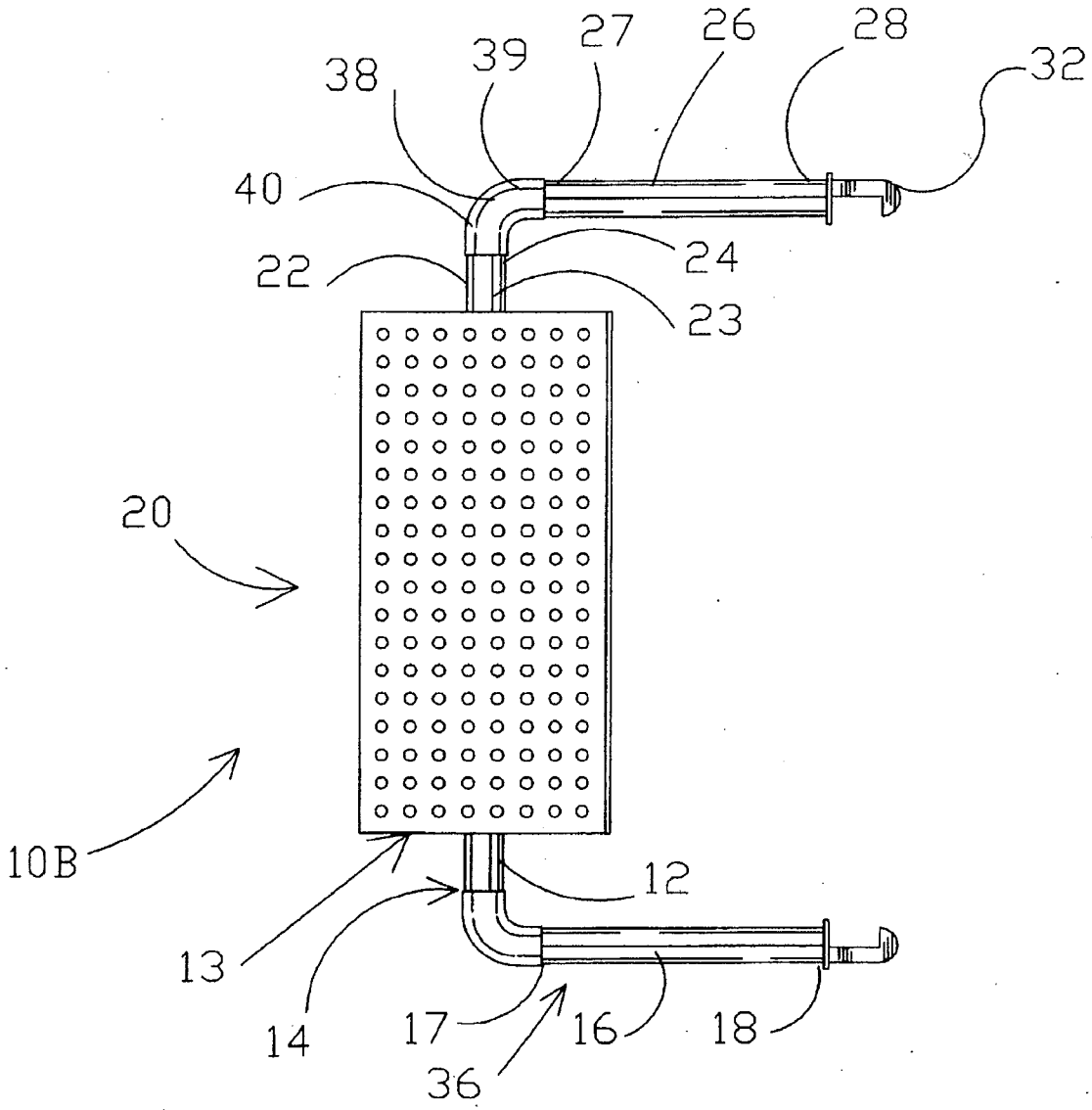
FIG. 3 is a right side elevational view of an alternate embodiment of the improved display rack of FIG. 2.

In FIGS. 2 and 3, the upper supporting member 22 is secured to an upper horizontal support 26 and the lower supporting member 12 is secured to a lower horizontal support 16. Each of the second ends 14, 24 of lower horizontal support 12 and upper horizontal support 22 carry an attachment member 32, most clearly shown in FIGS. 3 and 6, such that the improved display rack 10B can be secured to the existing shelving unit 44. In the preferred embodiment, the attachment member 32 resembles a typical shelf support bracket attachment member and, similarly, fits into the slotted bracket holder 46 such that the attachment member 32 is received within a slot 47 defined by the slotted bracket holder 46, most clearly shown in FIG. 6. It will be noted by those skilled in the art that any means for firmly securing the improved display rack 10B to the existing shelving unit 44 will be sufficient. For example, the attachment member 32 can be vise-like or clamp-like.

In FIG. 2, the lower horizontal support 16 and the lower supporting member 12 are integrally constructed to form a substantially "L"-shaped configuration. Similarly, the upper horizontal support 26 and the upper supporting member 22 are integrally constructed to form a substantially "L"-shaped configuration which is inverted. As stated previously, each of the second ends 18, 28 of the lower horizontal support 16 and the upper horizontal support 26 carry an attachment member 32 for fastening the display rack 10B to the existing shelving unit 44.

The display rack 10B illustrated in FIG. 3 depicts an alternate embodiment wherein the lower and upper supporting members 12, 22 and the lower and upper horizontal supports 16, 26 are separate members. As illustrated in FIG. 3, the lower supporting member 12 and the upper supporting member 22 are coupled to the respective horizontal support 16, 26 via an elbow coupler 38. More specifically, the elbow coupler 38 is configured to receive the first end 27 of upper horizontal support 26 at a first end 39 of the elbow coupler 38 and the second end 24 of the upper supporting member 22 is received at a second end 40 of the elbow coupler 38 such that the upper horizontal support 26 and the upper supporting member 22 are substantially perpendicular to each other. The lower horizontal support 16 and the lower supporting member 12 are secured to the elbow coupler 38 in a similar fashion. Of course, it will be noted by those skilled in the are that any means for securing the horizontal supports 16, 26 and the supporting members 12, 22 such that they are substantially perpendicular to each other will be sufficient. For example, the respective horizontal support and supporting member can be coupled using a clamp-like device such as a "U-bolt" or a "U"-shaped brace. Further, a vise-like device may be utilized or a member which is molded around the juncture of the respective horizontal support and supporting member may be utilized.

Further, it will be noted that the respective horizontal support and supporting member need not be perpendicular to each other as long as the attachment members are configured to firmly secure the improved display rack 10B to the existing shelving unit 44. Also, the horizontal supports and supporting members are not limited to a tube or rod-like construction. For example, the horizontal supports and/or supporting members can be slat-like. The configuration and construction of the rotatable display unit 20 must be such that the display unit 20 can rotate with relation to the vertical axis 34 and each of the second ends 18, 28 of the horizontal supports 16, 26 carry an attachment member 32 which secures the improved display rack 10B to the existing shelving unit 44.

Figure 4A:
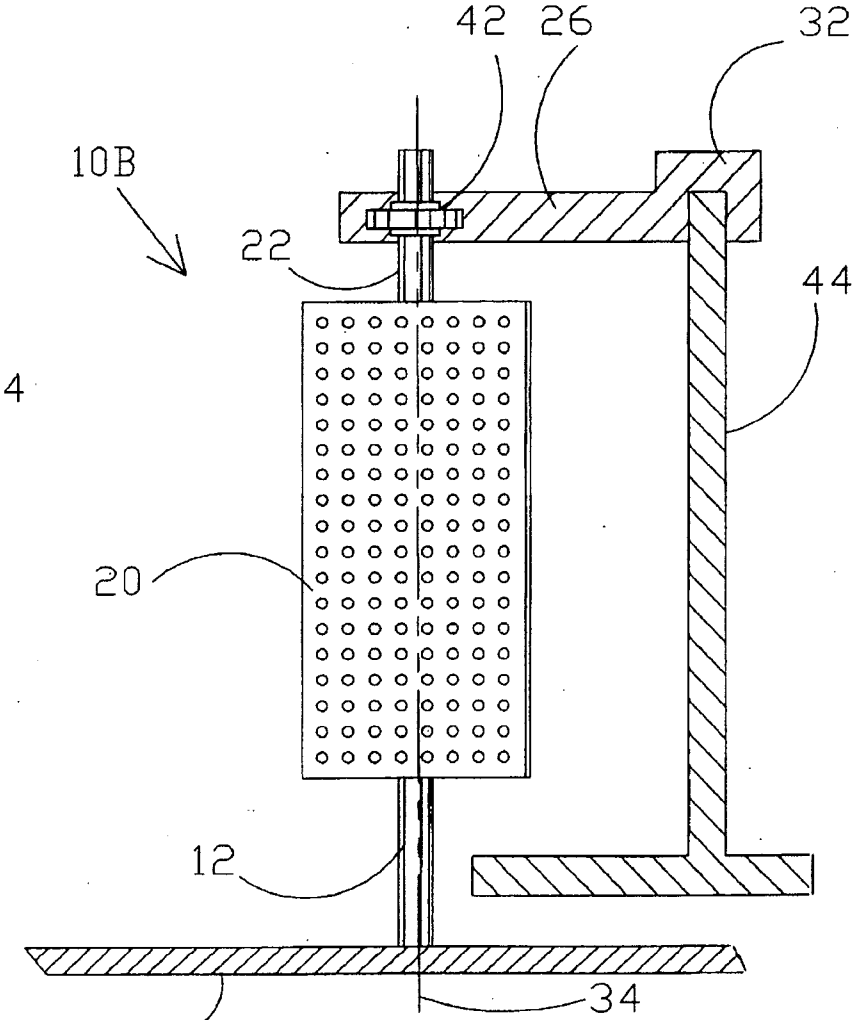
FIG. 4*a i*is a right side elevational view of the improved display rack of FIG. 4 wherein the lower supporting member rests on a floor.
Figure 4:
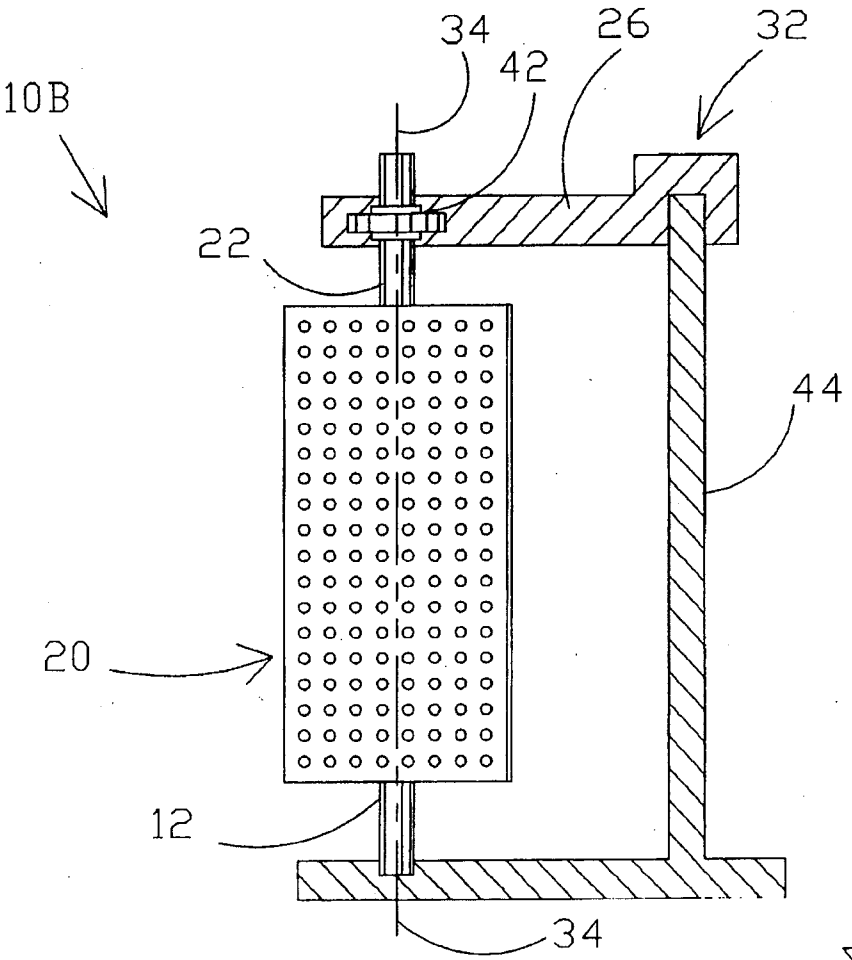
FIG. 4 is a right side elevational view of an alternate embodiment of the improved display rack of FIG. 2.

FIG. 4 illustrates an alternate embodiment of the improved display rack 10B wherein the second end 24 of the upper horizontal support 22 carries an attachment member 32 which is attached over the top of existing shelving rack 44. As illustrated in FIG. 4, the first end 23 of upper horizontal support 26 is attached to the upper supporting member 22 via a "U"-shaped brace 42. It will be noted that any other manner for securing the upper horizontal support 22, such that the rotatable display unit 20 can rotate, will be suitable. The attachment member 32 carried by the second end 28 of the upper horizontal support 26 is substantially hook-shaped such that the attachment member 32 can hook onto the top of existing shelving rack 44, as shown in FIG. 4. It will be noted by those skilled in the art that the attachment member 32 could be a clamp or vise device which can be secured to the top of the existing shelving unit 44.

The lower supporting member 12 is configured such that it rests on a selected horizontal support surface such as the base of the existing shelving unit 44 or the floor. As depicted in FIG. 4, the second end 14 of the lower supporting member 12 rests within the base of shelving unit 44 such that the improved display rack 10B is sufficiently supported and not easily knocked over. It will be noted that the lower supporting member 12 can also rest on a floor, as shown in FIG. 4*a*.

Figure 5:
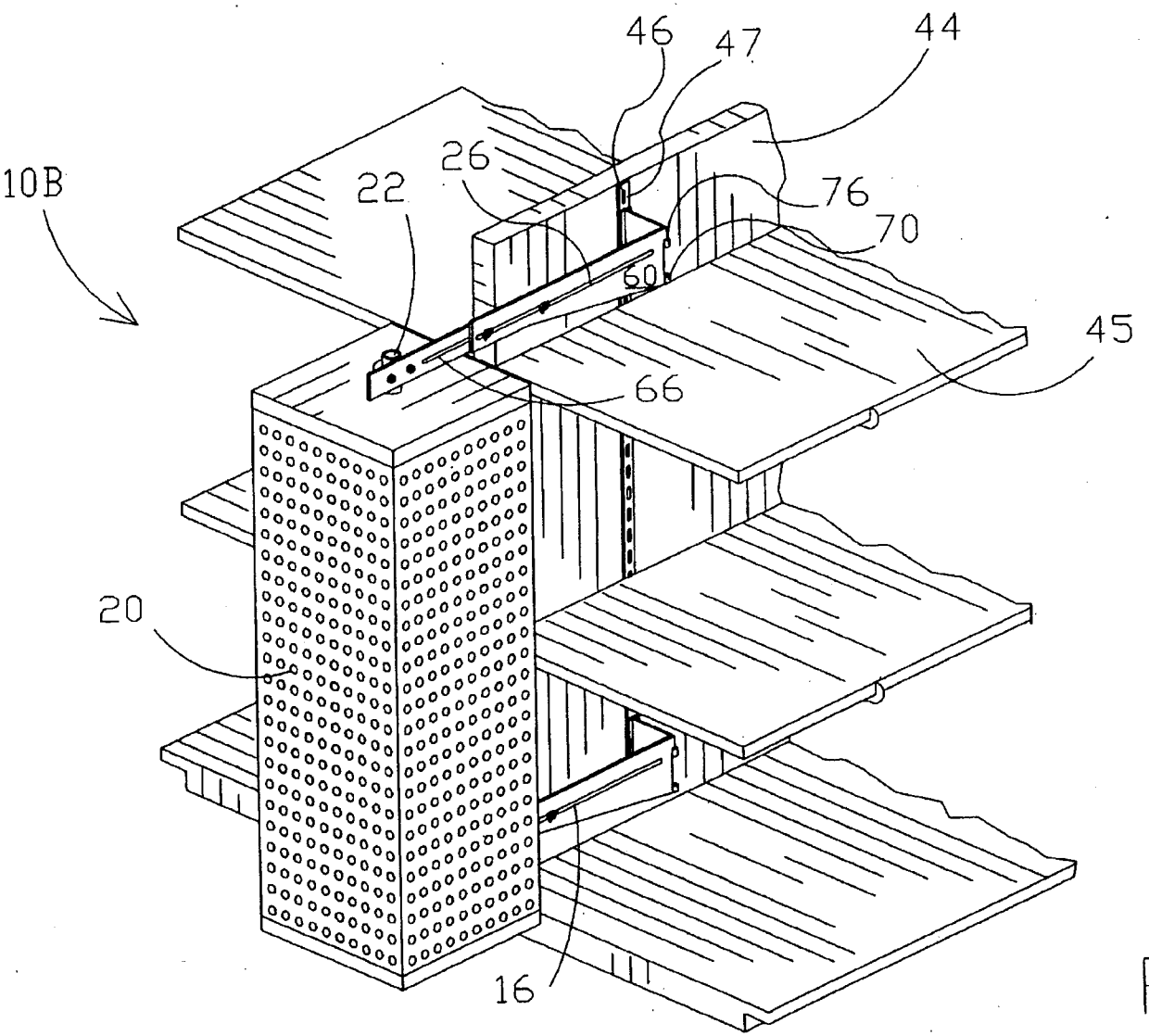
FIG. 5 is a perspective view of an alternate embodiment of the improved display rack of FIG. 2.
Figure 6:
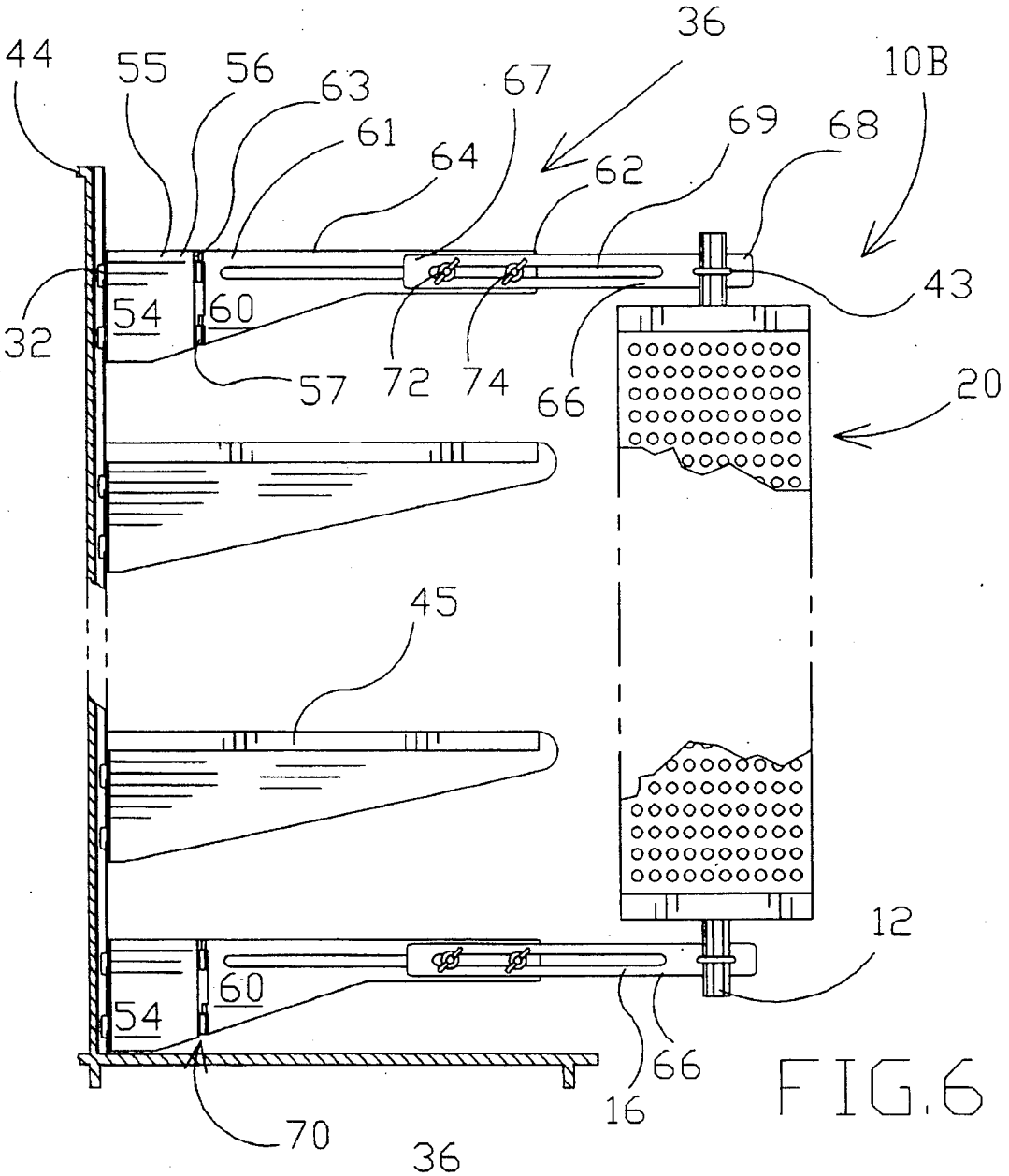
FIG. 6 is a partial side view of the improved display rack of FIG. 5.
Figure 7:
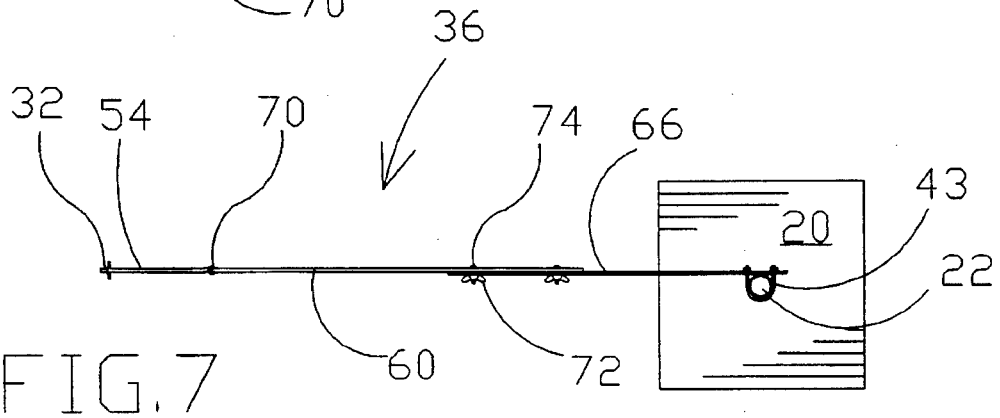
FIG. 7 is a top view of the improved display rack of FIG. 5.

FIGS. 5, 6 and 7 depict an alternate embodiment of the improved display rack 10B which is supported by the existing shelving unit 44. In this embodiment, each of the upper horizontal support 26 and the lower horizontal support 16 define a hinge 70 such that the rotatable display unit 20 can be pivoted away from the shelving unit 44, as shown in FIG. 5. In this manner, shelves 45 can be secured to shelving rack 44 within the slots 47 of the slotted bracket holder 46 not supporting the improved display rack 10B.

As shown clearly in FIG. 6, the upper horizontal support 26 is generally comprised of a hinged bracket, a first end of which is secured to an existing shelving unit 44 and a second end of which is secured to the upper supporting member 22. In the preferred embodiment, the upper horizontal support 26 is comprised of a bracket 54, a bracket extension 60 and a support extension 66. The bracket 54 defines a first end 55 and a second end 56. The first end 55 carries an attachment member 32, which is preferably at least one bracket attachment member, which fits securely into a selected slot 47 of the slotted bracket holder 46. The second end 56 defines a plurality of hinge slots 57.

The bracket extension 60 defines a first end 61, a second end 62 and a bracket slot 64. The first end 61 carries a plurality of hinge pins 63 which are received in the hinge slots 57 to form a hinge 70. In this manner, the bracket extension 60 can pivot around the hinge 70. The bracket slot 64 extends substantially the length of the bracket extension 60.

The support extension 66 defines a first end 67, a second end 68 and an extension slot 69. The extension slot 69 extends substantially the length of the support extension 66. The upper supporting member 22 is secured to the second end 68 of the support extension 66 via a U-bolt 43, as shown clearly in FIGS. 6 and 7.

The bracket slot 64 and the extension slot 69 provide a means for adjusting the distance the rotatable display unit 10B extends from the existing shelving unit 44. In the preferred embodiment, the distance is extended by aligning the bracket slot 64 and the extension slot 69 such that the display unit 20 is the desired distance away from the shelving unit 44. A securing device is received within the slots to secure the bracket extension 60 and the support extension 66 together. In the preferred embodiment, at least two bolts 74 are inserted through the aligned bracket 64 and extension slots 69 and wing nuts 72 are tightly secured to the bolts 74 to secure the bracket extension 60 and the support extension 66 together. It is preferable to secure the bolts 74 a sufficient distance apart to provide stability. The lower horizontal support 16 is constructed in a similar fashion as the upper horizontal support 26, as shown most clearly in FIG. 6.

Adjusting the length the display unit 20 is suspended from the shlving unit 44 provides control over the positioning of the display unit 20. For instance, as shown in FIG. 6, the display unit 20 rests against the end of the shelving unit 44 and is not rotatable. In this manner, the display unit 20 does not take up floor space yet provides space for displaying merchandise. The length can be adjusted such that the display unit 20 does rotate. It is preferable to use set screws 76 to lock the hinge 70 once in the selected position such that the display unit 20 does not pivot with respect to the hinge 70. It will be noted that the horizontal supports 16, 26 can be secured to the shelving unit 44 to prevent the display unit 20 from pivoting with respect to the hinge 70.

It will be noted that the construction of the hinge 70 is not limited to the embodiment discussed. Specifically, any hinge-like device can be employed such that the hinged portion of each of the upper and lower horizontal supports 16, 26 pivot around the hinge 70.

Further, it will be noted that although a preferred embodiment for adjusting the distance between the display unit and the shelving unit it will be noted that any number of means can be incorporated for adjusting the distance. For instance, the bracket extension and support extension can define holes which align and through which a bolt can be inserted and secured with a nut. In another embodiment the bracket extension can define a plurality of slots which extend in an vertical direction from the bracket slot and the support extension can define a plurality of nodules extensions which slide within the bracket slot and are received within the plurality of vertical slots. The disclosed embodiment is not intended to limit the means for adjusting the distance between the display unit 20 and shelving unit 44. It will be noted that a number of embodiments can be utilized to lengthen or shorten the distance.

Moreover, it will be noted that although a means for adjusting the distance of the rotatable display unit 20 to the shelving unit 44 is provided, the upper and lower supporting members 12, 22 can be secured to the second end 62 of the respective bracket extension 60 such that the distance is fixed.

From the foregoing description, it will be recognized by those skilled in the art that an improved display rack 10 offering advantages over the prior art has been provided. Specifically, the improved display rack 10 provides an easily deployed and inexpensive device for securement to existing shelving 44 or an existing suspended ceiling 50.

While a preferred embodiment has been shown and described, it will be understood that there is no intent to limit the invention to such disclosure but rather it is intended to cover all modifications and alternate constructions falling within the spirit and scope of the invention as defined in the appended claims.

Having thus described the aforementioned invention, I claim:

1. An improved display rack for use in conjunction with existing facilities which includes at least one shelving unit resting on a floor, said improved display rack comprising:

a rotatable display unit defining a surface on which selected merchandise is displayed, said rotatable display unit rotating relative to a substantially vertical axis;

an upper supporting member defining a first end and a second end, said first end being secured to a top portion of said rotatable display unit;

a lower supporting member defining a first end and a second end, said first end being secured to a bottom portion of said rotatable display unit, said second end of said lower supporting member being configured to be supported by the existing facilities; and, an upper horizontal support defining a first end and a second end, said first end being secured to said second end of said upper supporting member, said second end of said upper horizontal support carrying an attachment member for securing said upper horizontal support to the shelving unit, said upper horizontal support defining a length adjusting means for selectively adjusting a distance between said rotatable display unit and the shelving unit of the display facilities.

2. The improved display rack of claim 1 further including a lower horizontal support defining a first end, a second end and a length adjusting means, said first end of said lower horizontal support being secured to said second end of said lower supporting member, said second end of said lower horizontal support carrying an attachment member for securing said lower horizontal support to the shelving unit, said length adjusting means for selectively adjusting a distance between said rotatable display unit and the shelving unit.

3. The improved display rack of claim 2 wherein a hinge is carried by each of said upper horizontal support and said lower horizontal support proximate each of said second ends of said upper horizontal support and said lower horizontal support such that said rotatable display unit pivots with respect to said hinge.

4. The improved display rack of claim 3 wherein a position of said hinge is lockable when said rotatable display unit is pivoted to a selected location.

5. The improved display rack of claim 2 wherein each of said upper horizontal support and said lower horizontal support defines:

a bracket defining a first end and a second end, said first end of said bracket carrying at least one attachment member for securing said bracket to the shelving unit, said second end of said bracket defining at least one hinge slot, a bracket extension defining a first end, a second end and a bracket slot, said first end of said bracket extension defining at least one hinge pin, said at least one hinge pin being received by said at least one hinge slot such that a hinge is formed, said bracket slot extending a length of said bracket extension between said first end and said second end of said bracket extension, and a support extension defining a first end, a second end and an extension slot, said second end of said support extension secured to said second end of a respective support member, said extension slot extending a length of said support extension between said first end and said second end of said support extension, said extension slot and said bracket slot being aligned and receiving a securing device such that said rotatable display unit is a selected distance from the shelving unit.

6. The improved display rack of claim 5 wherein a position of said hinge is lockable when said rotatable display unit is pivoted to a selected location.

7. The improved display rack of claim 1 wherein said upper horizontal support defines a hinge proximate said second end such that said rotatable display unit pivots with respect to said hinge.

8. An improved display rack for use in conjunction with existing facilities which include at least one shelving unit resting on a floor, said improved display rack comprising:

a rotatable display unit defining a surface on which selected merchandise is displayed, said rotatable display unit rotating relative to a substantially vertical axis;

an upper supporting member defining a first end and a second end, said first end being secured to a top portion of said rotatable display unit;

a lower supporting member defining a first end and a second end, said first end being secured to a bottom portion of said rotatable display unit, an upper horizontal support defining a first end, a second end and a first hinge proximate said second end, said first end of said upper horizontal support being secured to said second end of said upper supporting member, said second end of said upper horizontal support carrying an attachment member for securing said upper horizontal support to the shelving unit;

a lower horizontal support defining a first end, a second end and a second hinge proximate said second end, said first end of said lower horizontal support being secured to said second end of said lower supporting member, said second end of said lower supporting member carrying an attachment member for securing said lower horizontal support to the shelving unit, said rotatable display unit pivoting with respect to said first and second hinges.

9. The improved display rack of claim 8 wherein a position of said first and second hinges are lockable when said rotatable display unit is pivoted to a selected location.

10. The improved display rack of claim 8 wherein each of said upper horizontal support and lower horizontal support defines a length adjusting means for selectively adjusting a distance between said rotatable display unit and the shelving unit.

11. The improved display rack of claim 8 wherein each of said upper horizontal support and said lower horizontal support defines:

a bracket defining a first end and a second end, said first end of said bracket carrying at least one attachment member for securing said bracket to the shelving unit, said second end of said bracket defining at least one hinge slot, a bracket extension defining a first end, a second end and a bracket slot, said first end of said bracket extension defining at least one hinge pin, said at least one hinge pin being received by said at least one hinge slot such that said first hinge and said second hinge are formed, respectively, said bracket slot extending a length of said bracket extension between said first end and said second end of said bracket extension, and a support extension defining a first end, a second end and an extension slot, said second end of said support extension being secured to said second end of a respective support member, said extension slot extending a length of said support extension between said first end and said second end of said support extension, said extension slot and said bracket slot being aligned and receiving a securing device such that said rotatable display unit is a selected distance from the shelving unit.

12. The improved display rack of claim 11 wherein a position of said first hinge and said second hinge are lockable when said rotatable display unit is pivoted to a selected location.

* * * * *